US009759047B2

(12) United States Patent
Benson et al.

(10) Patent No.: US 9,759,047 B2
(45) Date of Patent: Sep. 12, 2017

(54) WELL CASING PERFORATOR AND APPARATUS

(71) Applicant: Energyneering Solutions, Inc., Sisters, OR (US)

(72) Inventors: Benny Benson, Sisters, OR (US); Chadbourne Lovegren, Sisters, OR (US); Pete Terzo, Sisters, OR (US); Nick Fornalski, Sisters, OR (US); William Song, Sisters, OR (US)

(73) Assignee: Energyneering Solutions, Inc., Sisters, OR (US)

( * ) Notice: Subject to any disclaimer, the term of this patent is extended or adjusted under 35 U.S.C. 154(b) by 262 days.

(21) Appl. No.: 14/641,804

(22) Filed: Mar. 9, 2015

(65) Prior Publication Data

US 2015/0260020 A1 Sep. 17, 2015

Related U.S. Application Data

(60) Provisional application No. 61/951,164, filed on Mar. 11, 2014.

(51) Int. Cl.

| | |
|---|---|
| ***E21B 43/112*** | (2006.01) |
| ***E21B 29/00*** | (2006.01) |
| ***E21B 43/11*** | (2006.01) |
| ***E21B 29/06*** | (2006.01) |

(52) U.S. Cl.

CPC ..... *E21B 43/112* (2013.01); *E21B 29/00* (2013.01); *E21B 29/06* (2013.01); *E21B 43/11* (2013.01)

(58) Field of Classification Search

CPC ..... E21B 43/11; E21B 43/112; E21B 29/06; E21B 29/00

See application file for complete search history.

(56) References Cited

U.S. PATENT DOCUMENTS

| | | | | |
|---|---|---|---|---|
| 2,066,409 A * | 1/1937 | Loring | E21B 43/112 | 166/55.2 |
| 2,306,670 A * | 12/1942 | Sutliff | E21B 43/112 | 166/55 |
| 5,183,111 A * | 2/1993 | Schellstede | E21B 7/18 | 166/212 |
| 7,823,632 B2 * | 11/2010 | McAfee | E21B 29/005 | 166/55.7 |
| 2002/0005286 A1 * | 1/2002 | Mazorow | E21B 7/061 | 166/255.3 |

* cited by examiner

*Primary Examiner* — Yong-Suk (Philip) Ro

(57) ABSTRACT

A multi-directional drill-type device that can be shuttled vertically through well casings of various diameters to add new perforations at the desired spacing and positions along the casings to optimize well performance is disclosed. The apparatus is especially suited to add perforations to well casings of existing vertical LFG extraction wells. The apparatus includes a motor in a housing that may be purged with inert gas and with an output shaft that rotates around a first axis. The motor output shaft drives plural drill assembly modules that have drill bits that rotate around an axis normal to the first axis and which reciprocate into and out of the apparatus.

17 Claims, 9 Drawing Sheets

WELL CASING PERFORATOR AND APPARATUS

TECHNICAL FIELD

The present invention relates to apparatus and methods for perforating pipe, and more particularly to existing vertical landfill gas (LFG) extraction wells and other piping installations having constricted areas and corrosive environments.

BACKGROUND

Landfills are often prolific contributors of greenhouse gases, particularly methane (CH4), which according to the EPA, is a greenhouse gas that is approximately 21 times more potent than carbon dioxide (CO2). As a byproduct of waste disposal and aerobic and anaerobic digestion by microbes of organic matter, landfills produce a variety of gases, including methane and carbon dioxide and others. Some of these gases, typically composed of mostly methane and carbon dioxide, may be collected in compliance with state and federal regulations and combusted in a flare system. However, methane, in particular, may be utilized with contemporary technology to generate electricity by combustion, fuel industrial boilers, or be converted to pipeline quality High-BTU gas so there is inherent value in using methane. In addition to obvious economic advantages derived from using methane as a fuel, flaring methane from the landfill reduces greenhouse gas emissions relative to the situation where methane is neither utilized as a fuel nor flared.

Landfills frequently have gas extraction systems to capture landfill gases. The gases are typically drawn out of a landfill with a low pressure vacuum via a wellfield collection and control system (GCCS). The wellfield typically consists of multiple gas extraction wells that extend deep beneath the surface of the landfill to pull methane from a location near the bottom of the landfill. Each extraction well extends up to the surface of the landfill and is connected with other wells, creating a piping matrix, so that a vacuum can be pulled with one centralized blower or compressor.

Landfill gas extraction wells are perforated along their lengths to allow the gases to be extracted from the waste deposits. There are many factors that influence the effectiveness of a landfill gas extraction well. For example, there may be a liquid-level blockage, insufficient perforation coverage, failed perforations, or non-perforated risers that prohibit the vacuum from being applied to the surrounding waste and therefore decrease the efficiency of gas extraction.

In the instance of a high liquid level, a dewatering pump is often installed in the extraction well to remove the liquid and allow the vacuum to pull on the waste through the perforations again. But in the other three aforementioned instances, there is very little to nothing that can be done to restore the extraction well. Therefore, there is a need for an apparatus and method to restore these poorly performing or non-performing LFG extraction wells.

SUMMARY OF INVENTION

The subject invention is a multi-directional drill-type device that can be shuttled vertically through well casings of various diameters to add new perforations at the desired spacing to optimize well performance. The apparatus is designed to add perforations to well casings of existing vertical LFG extraction wells.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF ILLUSTRATED EMBODIMENTS

The invention will now be described in detail with reference to the drawings. The invention comprises a drill-type perforation apparatus, well mount structures that support the perforation apparatus, and an electrical controller that controls operation of the perforation apparatus.

Figure 1:
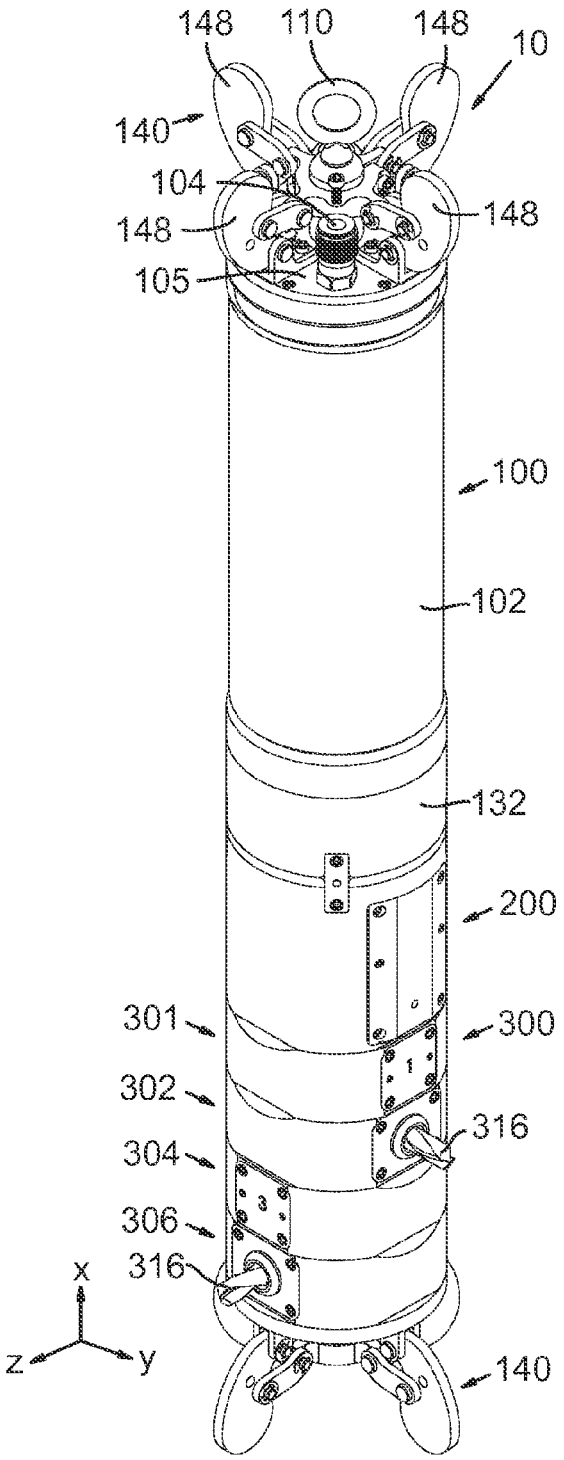
FIG. 1 is a perspective isometric view of the assembled perforation apparatus according to the present invention.

With reference now to the drawings, a first illustrated embodiment of a perforation apparatus 10 according to the present invention is illustrated in an assembled condition and in isometric view in FIG. 1. Perforation apparatus 10 includes three primary structural components: a motor assembly 100, a drive assembly 200 and a drill assembly 300, each of which is detailed below.

As detailed below, in normal use the apparatus 10 is inserted into an existing pipe that is typically extending vertically relative to a nominally horizontal ground plane. As such, at times in this description the relative positions of structural components of the apparatus 10 are described using relative directional terms. In all cases, these terms are based upon the vertical orientation of apparatus 10 as it is positioned in a vertically oriented pipe. The upper or top end of the apparatus 10 is thus the upper end of the apparatus as shown in the view of FIG. 1. Other relative directional terms correspond to this convention: the "lower" or bottom end of the apparatus is opposite the upper end. "Inner" or "inward"

refers to the structural center of the apparatus and the direction from the outer portions of the device toward the center of it, and so on. An X-Y-Z axis grid is shown in FIG. 1. The X-Y plane is defined as the plane transverse to the ground plane and thus the plane extending in the vertical direction—the apparatus travels in a pipe along an axis parallel to the X direction. The Y-Z plane is the parallel to the ground plane and transverse to the X-Y plane.

The assembled perforation apparatus 10 as seen in FIG. 1 is generally described as an elongate cylindrical device that comprises the three primary structural components mentioned above, the motor assembly 100, the drive assembly 200 and the drill assembly 300, which are assembled in a stacked arrangement and which have like diameters. The diameter of apparatus 10 is such that the apparatus is insertable into a vertically oriented in-ground pipe (such as pipe 402, FIG. 8) for upward and downward reciprocal movement of the apparatus within the pipe. The apparatus 10 is lowered into the pipe to a desired depth and a controller activates the motor so that the drills, which are normally in a retracted position such that they are retained in the drill assemblies, are driven outwardly while axially rotating into the pipe to form holes in the pipe. The drills are then retracted to the normal, storage position and the apparatus 10 is raised or lowered a predetermined distance to drill additional holes. This basic procedure is repeated as desired. As noted above, apparatus 10 is designed to shuttle into and out of and within casings of existing vertical LFG extraction wells and as such, when the apparatus 10 is within a well casing it is operating in an environment that may be rich in explosive gasses such as methane. Because apparatus 10 includes an electric motor, the cylindrical motor casing 102 of motor assembly 100 is adapted so that it may be purged with an inert gas such as nitrogen that is filled through a purge fitting 104 in the upper cap 105 of the casing. An exhaust purge fitting 106 allows all oxygen to be exhausted from the casing as the inert gas is pumped into the casing; once oxygen is purged, the inert gas is pressurized to completely eliminate the possibility of a combustible gas mixture accumulating within the motor casing.

The motor casing 102 features a custom electrical connector fitting 108 in cap 105 that is completely sealed and designed to withstand corrosive environments such as those encountered in LFG extraction wells. A suspension loop 110 attached to the top of the cap 105 and allows a suspension cable to be attached to the apparatus 10 as detailed below. As also detailed below, a centering skid assembly 140 that helps to maintain the position of apparatus 10 within pipe 402 during operations is attached to the cap 105 of motor casing 102. Specifically, an upper centering skid assembly 140 is attached to the cap 105 and a lower centering skid assembly 140 is attached to the bottom plate 342 of the lowermost drill assembly module. The centering skid assemblies thus define a mechanism for maintaining the position of apparatus 10 near the axial center of the pipe while drilling operations are taking place.

Figure 2:
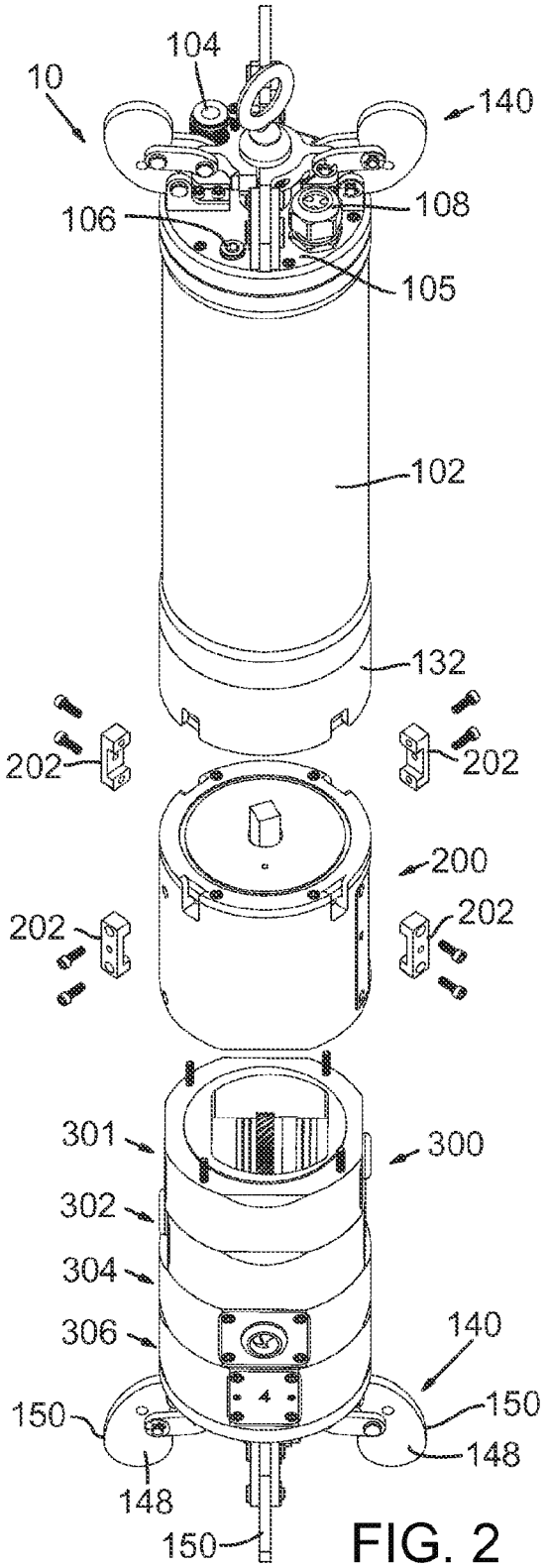
FIG. 2 is a perspective exploded view of the perforation apparatus according to the present invention and shown in FIG. 1, showing the three basic structural components of the apparatus exploded relative to one another.

The relative orientation of the three primary structural components, the motor assembly 100, the drive assembly 200 and the drill assembly 300, are shown in FIG. 2 with the components separated. As detailed below, the motor that is contained in motor assembly 100 serves to drive the drive assembly through an input drive shaft, which in turn causes rotation and extension/retraction of the drill bits between their home, retracted position, and their extended position.

Figure 3:
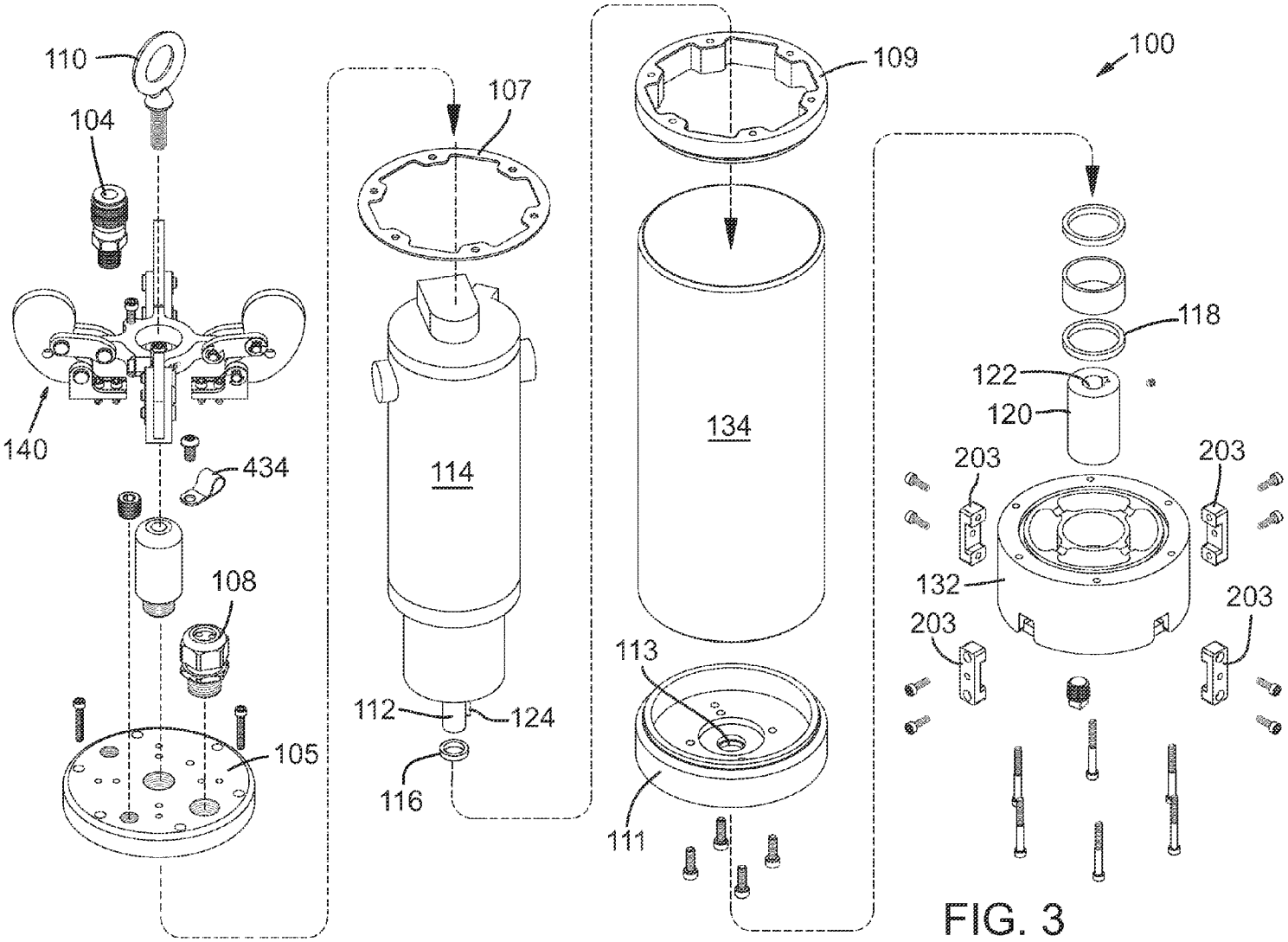
FIG. 3 is a perspective exploded view of the motor assembly component of the perforation apparatus according to the present invention.

The motor casing 102 may comprise multiple cylinders that are fit together with centering rings and O-rings to provide a safety seal against landfill gas intrusion. The multiple cylinders that comprise casing 102 and their connections to one another is best illustrated in the exploded views of FIGS. 2 and 3. For example, motor casing 102 comprises and a cap 105, a motor drive link casing 132 and an intermediate casing module 134 that is the primary container for motor 114. A gasket 107 is interposed between cap 105 and a top flange 109 on the upper end of casing module 134, and a motor module face plate 111 attaches to the lower end of casing module 134. The output shaft or motor drive shaft 112 of motor 114 extends out of the lower end of motor 114, through a shaft opening 113 in motor module face plate 111, and is sealed with two shaft seals 116 and 118 to prevent gas intrusion through the shaft connection.

A motor drive linkage 120 meshes via a keyed socket 122 with a cooperatively formed key 124 on the drive shaft 112. As explained below, the motor drive linkage 120 interconnects the output of motor 114 to the drive components of drive assembly 200. It will be appreciated that the structure of the motor assembly 100 allows for easy disconnection of components by removing attachment bolts and the like and then separating the components for maintenance purposes.

The motor assembly 100 attaches to the drive assembly 200 with four mending brackets 203 that are spaced around the periphery of the cylindrical housing components. More specifically, the mending brackets 203 are attached to and spaced around the motor drive linkage casing 132 that is the lowermost portion of motor drive assembly 100 and interconnect the motor assembly 100 to the drive assembly 200. The entire motor assembly 100 is sealed to prevent leakage of gas from, or into the assembly, and is fabricated to allow ease of maintenance. The brackets 203 along with the drive linkage design specifically allow ease-of-maintenance. And as may be seen in the exploded view of FIG. 3, for example, various bolts and other connectors are used to assemble the components of the motor assembly 100. These connectors are not detailed herein as they are well within the skill of those in the art.

Figure 4:
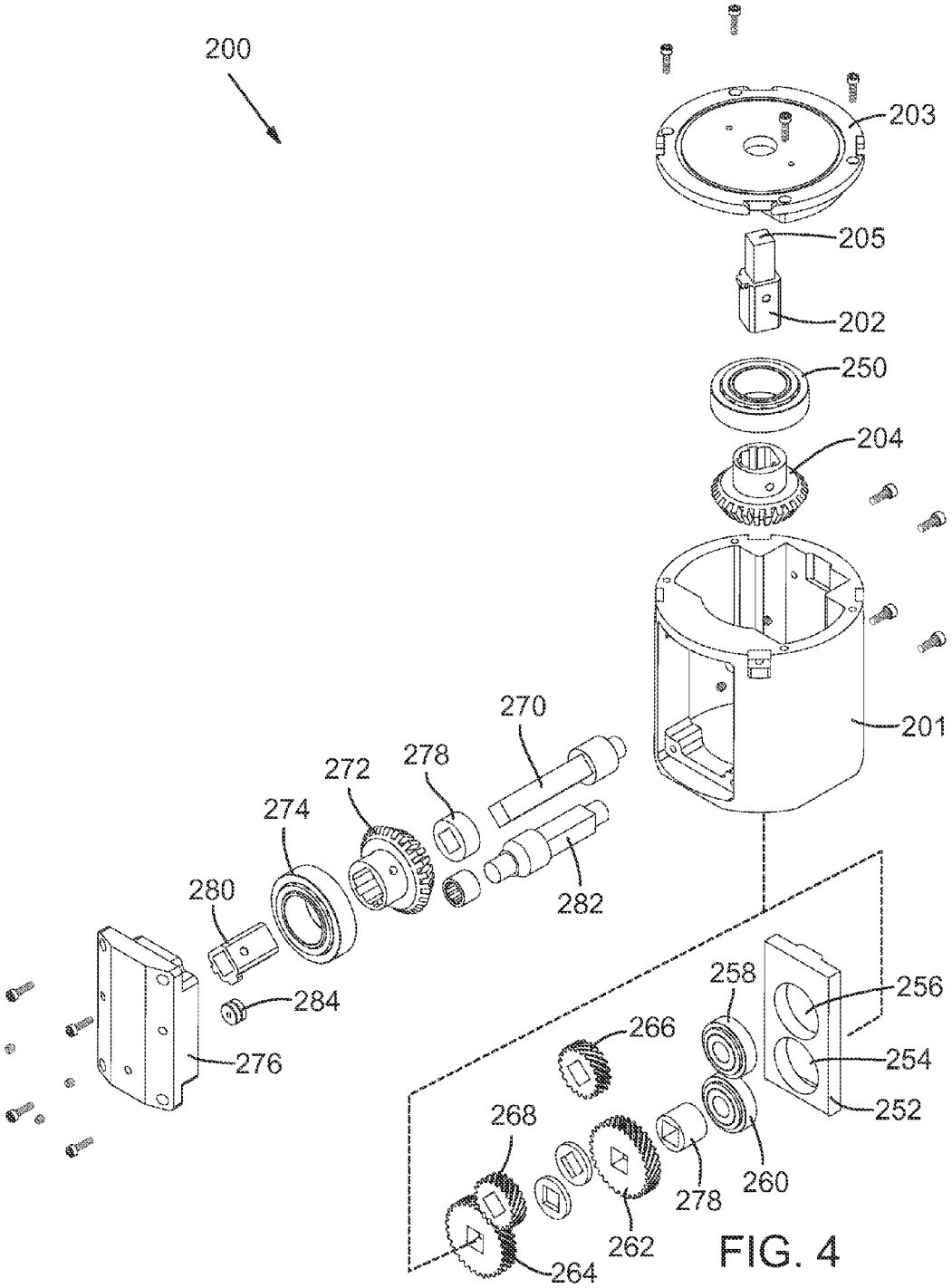
FIG. 4 is a perspective exploded view of the drive assembly component of the perforation apparatus according to the present invention.

The drive assembly 200 is shown in exploded view in FIG. 4 and the drive components detailed below are housed in a drive input casing 201 that is capped with a drive cylinder lid 203 (and attached thereto with connectors, again which are not detailed but some of which are shown in the drawings). A drive miter gear adaptor 202 has its upper end 205 extending through a bore in the drive cylinder lid 203 and adapted for connection to the motor drive linkage 120. The opposite or lowermost end of drive miter gear adaptor 202 is directly attached to a first drive miter gear 204 and there is a tapered roller bearing 250 attached to the drive miter gear 204.

A drive cylinder plate 252 is retained within drive input casing 201 and has two bores 254 and 256 into which roller bearings 258 and 260 are fitted. An output drive shaft 282 has its inner end received in roller bearing 260 and includes a pair of helical gears 262 and 264 attached thereto that mesh with helical gears 266 and 268 on upper shaft 270, which has its inner end received in roller bearing 258. The paired, meshed helical gears 262 and 266, and 264 and 268 are provided due to the relatively high torque inherent in the device and to insure that the teeth on the gears do not shear. A second drive miter gear 272 is attached to the outer end of upper shaft 270, including a roller bearing 274. The outer ends of drive shaft 282 and 270 are secured in bores in an outer plate 276. From the exploded view of FIG. 4 it will be seen that the assembly includes spacers such as spacers 278 and adapters such as adapter 280 as necessary.

Figure 6:
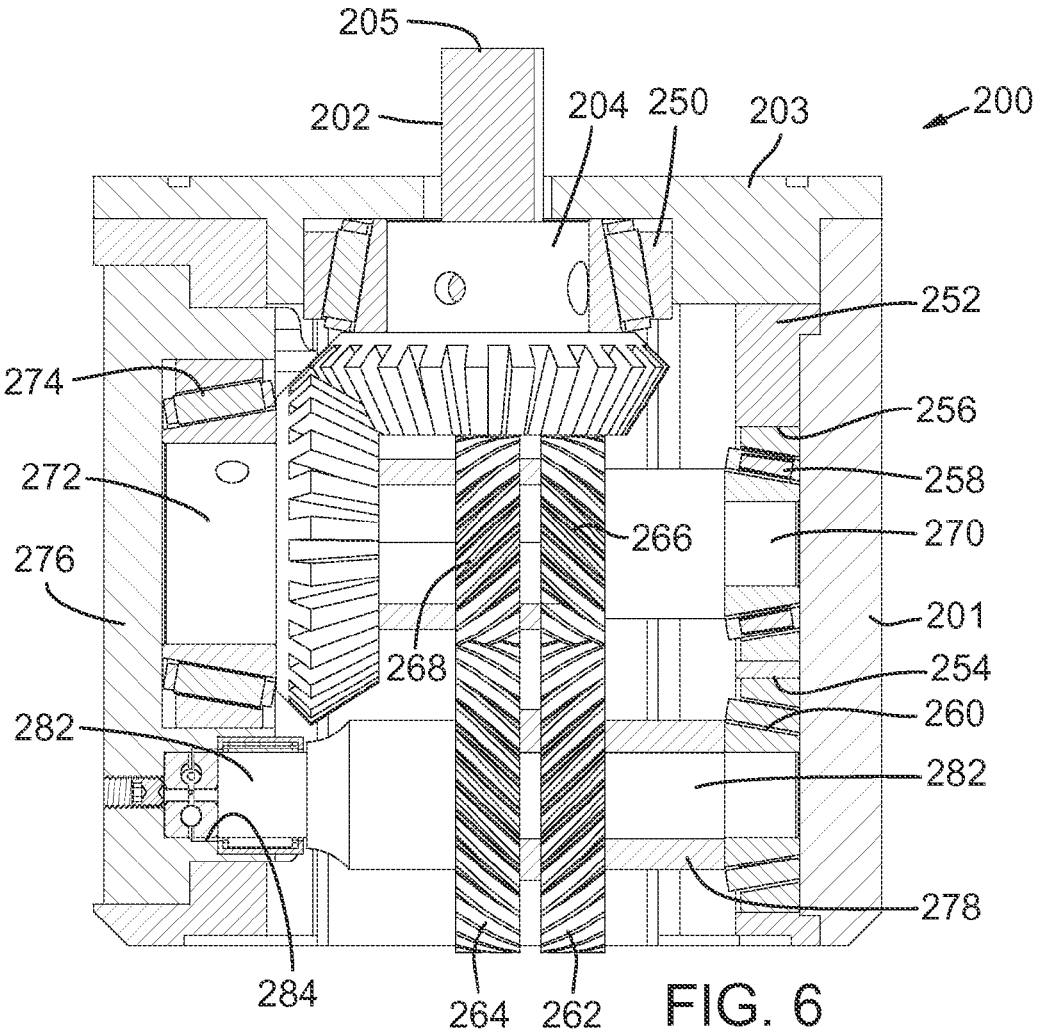
FIG. 6 is a partial sectional view of a drive assembly.

The drive assembly 200 is shown in partial cross section in FIG. 6 where it may be seen that the outer end of shaft 282 is fitted with a roller bearing 284 and the second drive miter gear 272 is fitted with roller bearing 274 in an upper seat in plate 276. Operationally, it will be appreciated that as the drive miter gear adapter 202 is axially rotated (by operation of motor 114), the meshed miter gears 204 and 272 cause rotation of upper shaft 270, with direct simultaneous rotation of helical gears 266 and 268. As those helical gears are meshed with helical gears 262 and 264, respectively, lower shaft 282 is simultaneously axially rotated.

Figure 11A:
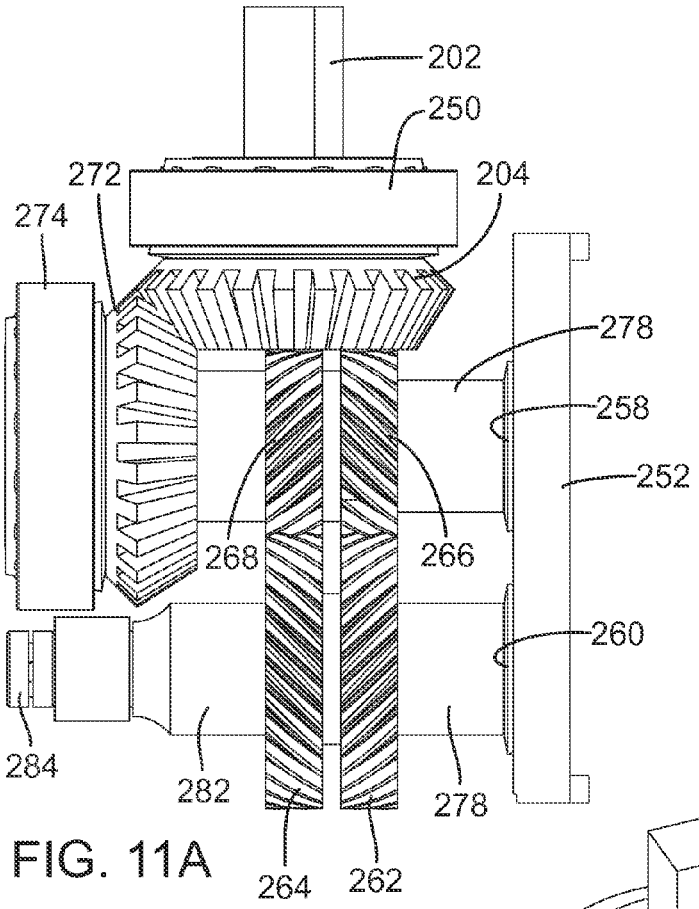
FIG. 11A is an elevation view of select components of a drive assembly shown in isolation without the casing.
Figure 11B:
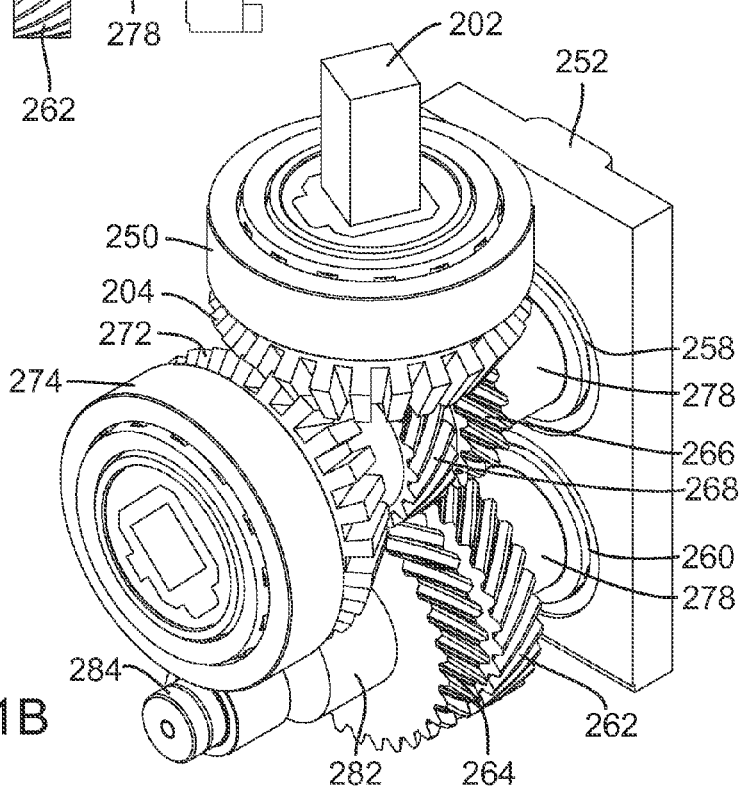
FIG. 11B is a perspective view the drive assembly shown in FIG. 11A.

The drive assembly 200 is also shown in isolation in FIGS. 11A and 11B, from differing perspectives to illustrate the structural interconnections of the components.

Figure 5:
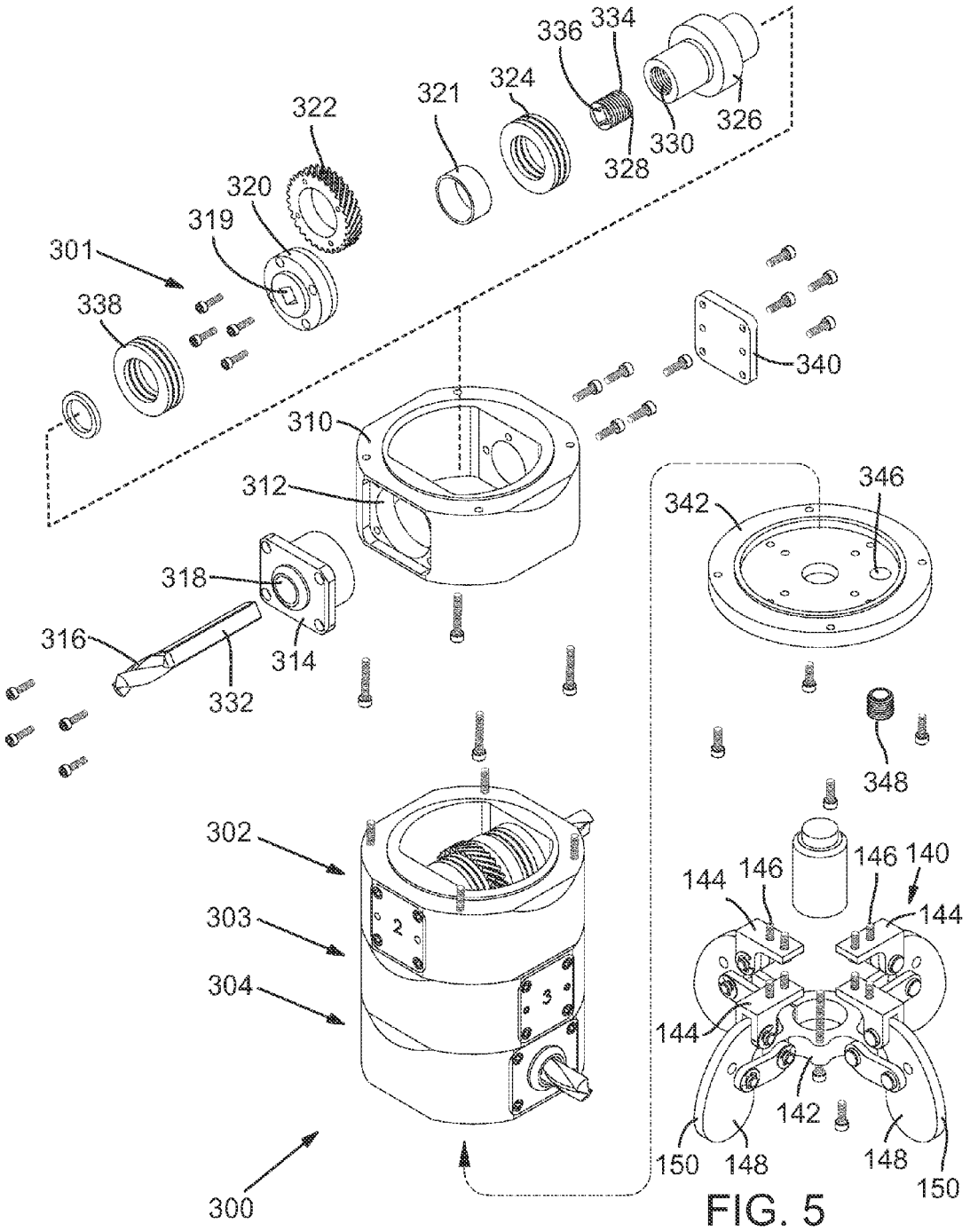
FIG. 5 is a perspective exploded view of the drill assembly component of the perforation apparatus according to the present invention, showing three ganged drill assemblies connected together and a centering skid assembly.

Turning to FIG. 5, the drill assembly 300 is shown in an exploded view to illustrate its main components. It will be appreciated that apparatus 10 is adapted so that plural individual drill assembly modules may be ganged together as shown in FIGS. 1 and 5—the combination of modules is identified with reference number 300. When plural individual modules are ganged together, stacked atop one another as shown in FIGS. 1 and 5, the individual drill assembly modules are identified with different reference numbers, such as 301, 302, 304 and 306. When plural drill assembly modules are utilized; one drill bit is associated with each drill assembly module and each drill assembly module is rotated relative to its adjacent module(s) so that the drill bits are driven in different directions, toward desired points around the cylindrical well pipe.

Each drill assembly module 301, 302, etc., is identical to the others and comprises a drill cylinder or housing 310 having an opening 312 into which a front plate 314 is attached. A drill bit 316 extends through central opening 318 in plate 314 and has its square base 332 extending through a square opening 319 in drill bit socket (or chuck) 320. A drill bit helical gear 322 is attached to socket 320 and a thrust bearing 324 is interposed between the gear 322 and drill bit thrust screw housing 326. A drill bit thrust screw 328 has a cylindrical outer surface 334 that is threaded and which threads into threaded opening 330 in the thrust screw housing. When assembled, as the helical gear 322 (which meshes with helical gear 264 in drive assembly 200) is rotated the drill bit socked 320 simultaneously rotates, which causes the drill bit 316 to rotate. The base end 332 of the drill bit 316 is received in the square central opening 336 of thrust screw 328. Accordingly, as the bit 316 rotates the thrust screw 328 also rotates. It will be understood, therefore, that as helical gear 322 rotates in a first direction the bit 316 rotates in the same rotational direction and is simultaneously driven outward from the housing 310 (and thus into the wall of the pipe in which the apparatus 10 is residing) as thrust screw rotates in thrust screw housing 326. The drive motor 114 is a variable speed reversible motor, preferably with encoder feedback. When the output shaft of the motor is reversed, the drill bit 316 rotates in the opposite axial direction and the thrust screw is threaded back into the thrust screw housing to retract the bit back to the home position.

The pitch diameter of the helical gear 322 has the same pitch diameter as the helical gears 262 and 264 in drive assembly 200 so as to not modify the torque ratio from motor 114 to drill bit 316.

Each drill assembly module is composed of individual components as shown and as described, which may all be removed and replaced individually, allowing any component to be easily replaced in the event of a mechanical failure.

The front plate 314 allows the drill bit 316 to project out from its face and drill through the wall of the pipe 402 into which apparatus 10 is inserted. The diameter of opening 318 is sized to restrict waste and chips from the drilling process from entering the drill cylinder. The front plate 314 is also designed to support the thrust bearing 324 and a thrust bearing 338 on the opposite side of socket driver 320 and, in turn, the drill bit socket driver, which is fastened to helical gear 322. A back plate 340 is attached to and closes a rear opening of the housing 310.

In the event that outside waste or chips from the drilling process enter the front plate opening, they are blocked from progressing into the drill cylinder's internal components by multiple thrust bearings and tight tolerances. The drill bit 316 is machined with a filleted transition between its square drive shank to the drill portion to eliminate the possibility of outside material and waste from becoming smashed between the drill bit and the cylinder as it retracts back into the drill cylinder.

The drill bit's profile is such that its cutting edges are sufficient to drill all the way through the desired pipe material. The drill bit is preferably composed of cobalt steel, which tends to be less likely to shatter when drilling through a ductile plastic, such as HDPE, and then hits 1" to 3" gravel.

The method for replacing a drill bit is designed to be quick when out in the field. The back plate 340 is quickly removed with four screws, where the one screw (not shown) that connects the drill bit 316 to the driving mechanism defined by the thrust screw 328 and thrust screw housing 326 is exposed. Once the connecting screw is removed, a worn or damaged drill bit is easily replaced with a new drill bit.

The drill bit socket driver 320, which drives the drill bit, is wedged between two thrust bearings 324 and 338 to constrain its motion in the lateral direction. It is then fitted around the drive mechanism with a sleeve bearing 321 between thrust bearing 324 and the socket driver 320 to restrict motion to only rotation.

Continuing with a description of the mechanisms that translate the rotation of the motor drive shaft to rotation of the drill bit on an axis normal to the axis of the motor drive shaft, the drive mechanism contains a drill bit thrust screw 328 that has a square socket 336 to receive the square end 332 of the drill bit 316 and transmit power to the drill bit. The drill bit thrust screw preferably features 32 pitch threads on its external surface 334, which meshes with the internally threaded opening 330 of thrust screw housing 326, to provide a precise travel speed outward or inward as the drill bit 316 rotates. The drive mechanism works with the rotation of the helical gears to cause the drill bit to project out of the drill cylinder and drill the desired pipe. The drive assemblies thus facilitate rotation of the drill bits about an axis normal to the axis about which the motor drive shaft rotates.

The drill assembly modules such as 301, 302, 304, 306 are exactly the dimension with the height being the same as the pitch diameter of the driving helical gear, so that the gears can mesh perfectly with each other—spaced by the single-drill modules.

As noted, plural drill assembly modules can be stacked such that they operate simultaneously with adjacent drill assembly modules. Apparatus 10 can thus operate with anywhere from one to four drill assembly modules, with the associated drill bits oriented at 90 degree angles around the perimeter of the apparatus where four drill assemblies are utilized.

Adjacent drill assembly modules are fitted with either a right-hand or left-hand helical gear 322 and oriented so that the helical gears can mesh directly without the need of an intermediary gear to correct the direction of travel for the drill bit.

It has been found that helical gears 322 are preferred over miter, bevel, or other gears due to their greater efficiency from gear-to-gear and their ability to mesh without the need of an intermediary gear to correct the direction of rotation. Nonetheless, other types of gears will work to translate the axial rotation of the drive motor's output shaft into axial rotation of the drill bit normal to the axis of rotation to the drive motor output shaft.

Figure 7:
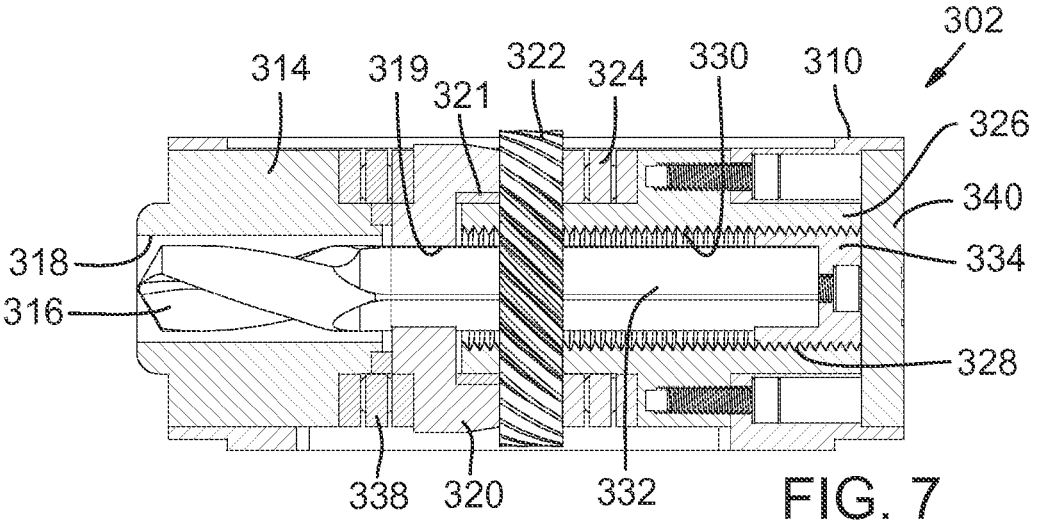
FIG. 7 is a partial sectional view of a drill assembly.

A drill assembly module 302 is shown in partial cross section in FIG. 7 to detail the structural components described above.

The bottom plate 342 on the drill assembly features a drain port 346 with a threaded plug 348 to evacuate any unwanted fluid buildup within the drill cylinder section of the device. It will be appreciated that the bottom of the apparatus 10 may optionally be fitted with a downwardly pointing conical cap so that the apparatus 10 will be able to push debris out of the way as it descends downwardly in a pipe 402.

With continuing reference to FIG. 5, a centering skid assembly 140 is attached to the bottom plate 342 and is identical to the centering skid assembly 140 attached to the cap 105 described above. Each centering skid assembly comprises a mounting bracket 142 that has four skid brackets 144 spaced at 90 degree angles relative to one another. The four skid brackets are attached (as with bolts 146) to the cap 105 and bottom plate 342. Each skid bracket 144 mounts a skid 148 that has an arcuate shaped outer surface 150 and which extends beyond the outer circumference of apparatus 10 (see, e.g., FIGS. 1 and 2). When apparatus 10 is inserted into a pipe 402 the curved outer surfaces of the skids 148 bear against the interior surface 403 of the pipe (FIG. 8) in order to maintain the apparatus 10 positioned near the center of the pipe, and to maintain the orientation of the apparatus 10 near the center of the pipe as the apparatus 10 is operated and the drill bits 316 are boring holes through the pipe 402. The centering skid assemblies are adjustable to accommodate pipes 402 having different diameters. Thus, the skids 148 may be adjusted in brackets 144 so that the distance between the outer surfaces 150 of diametrically opposed skids is roughly equal to the diameter of the pipe into which apparatus 10 is being inserted. The centering skid assemblies are illustrated with four skids at approximately 90 degree angles. Of course, the function of the skid assemblies may be accomplished with fewer and greater numbers of skids.

All materials within the drill-type device are designed to withstand corrosive environments.

Figure 8:
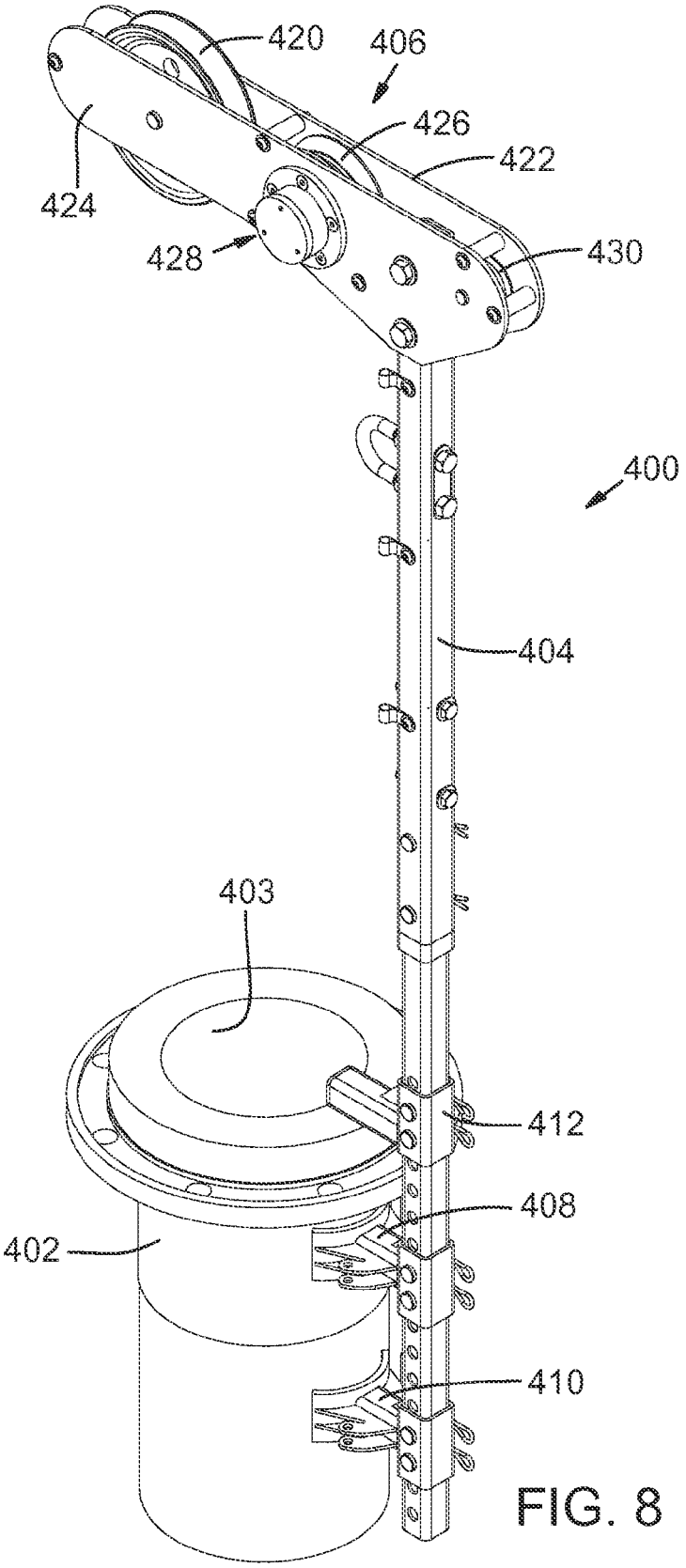
FIG. 8 is a perspective isometric view of the well mount support apparatus that supports the perforation apparatus according to the present invention, and illustrating an exemplary LFG pipe with which the apparatus may be used.
Figure 9:
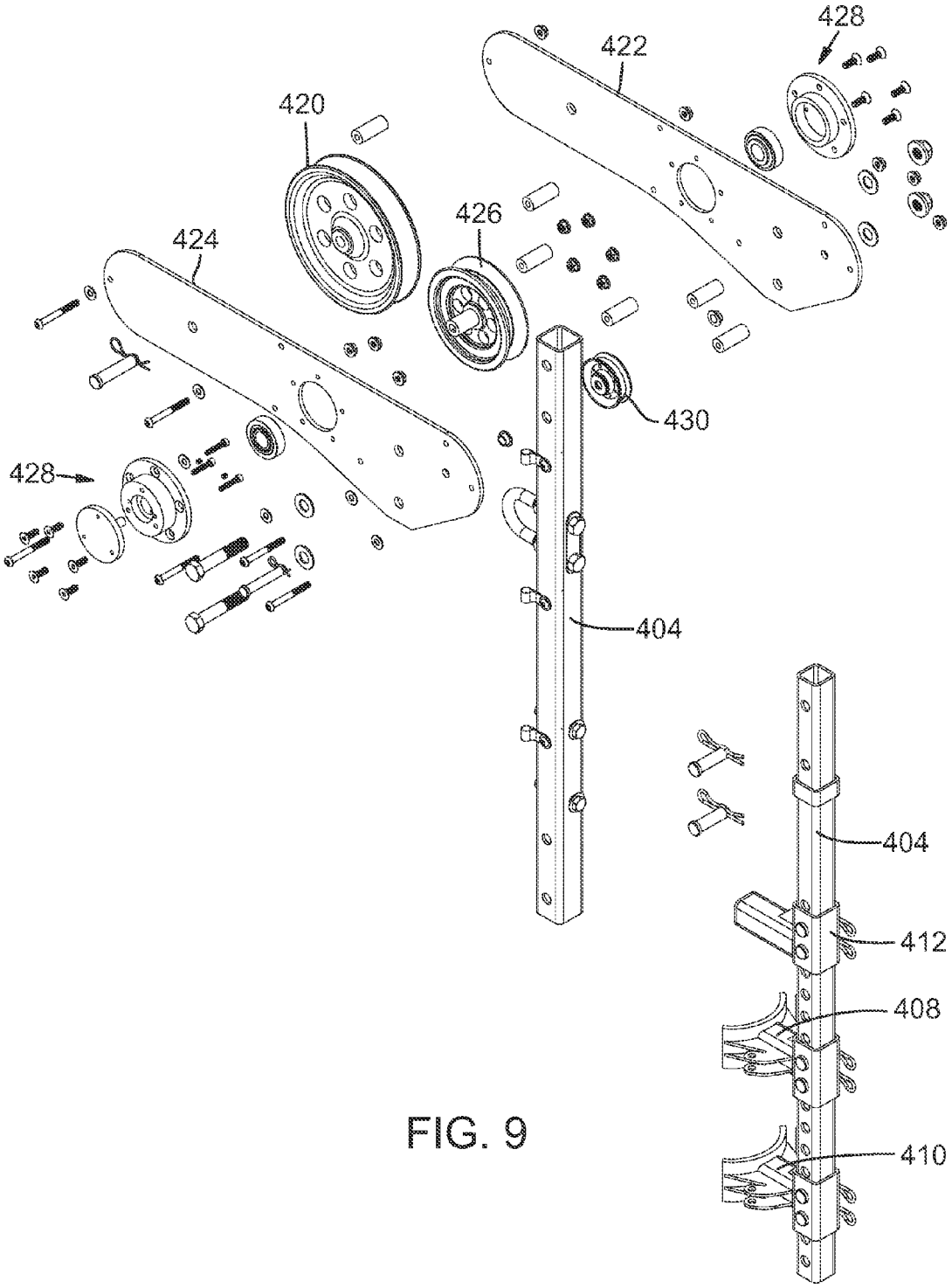
FIG. 9 is a perspective exploded view of the well mount support apparatus shown in FIG. 8.

A well mount support 400 is illustrated in FIGS. 8 and 9 and serves to support apparatus 10 above an in-ground pipe 402, to suspend the apparatus 10 and to shuttle the apparatus 10 into and out of the pipe to desired locations within the pipe. The well mount support 400 is defined by a vertically extending main arm 404 that has a pulley assembly 406 at its upper end, and two vertically adjustable brackets 408 and 410 that serve to mount the support 400 to the exterior of pipes 402 having different diameters. The brackets 408 and 410 may be attached to pipe 402 in any conventional manner such as a strap (not shown), or by bolting the brackets to the pipe. A support nub 412 that is also vertically adjustable along the main arm 404 rests on the upper edge of the pipe 402 during the process of attaching the support 400 to pipe 402 to provide intermediate support while the brackets 408 and 410 are being located and tightened.

The main arm 404 of the well mount support 400 may be separated into pieces as shown in FIG. 9, and may be disconnected from the brackets 408, 410 and nub 412 to simplify transportation of the support 400 in a disassembled condition, and attachment to the various pipes that are to be drilled in the field.

A winch having a support cable that attaches to loop 110 of apparatus 10 is used to shuttle the apparatus into and out of pipe 402. The winch is not shown in the drawings, but may be and typically is attached at an appropriate location, for instance, to main arm 404. The winch is preferably electric and under the control of a central controller, but a manual winch may be used if appropriate for some installations.

Pulley assembly 406 is attached to the upper end of main arm 404 and includes a pulley wheel 420 that is rotatably mounted between a pair of opposed mounting plates 422, 424. Pulley wheel 420 functions as the support for the electrical power and control cable that has one end attached to apparatus 10 and its opposite end attached to the controller. Separately, an encoder pulley wheel 426 is rotatably mounted between head plates 422, 424 and includes an encoder 428. As illustrated in the exploded view of FIG. 9, a guide pulley wheel 430 is rotatably mounted between the head plates on the opposite side of arm 404. Appropriate bearings and spacers are used in the pulley assembly 406, along with quick-type connectors that make the job of field assembly, disassembly and maintenance simple. The support cable that extends between the winch and attaches to attachment loop 110 on apparatus 10 extends over guide pulley wheel 430, over encoder pulley wheel 426, and attaches to the attachment loop.

Figure 10:
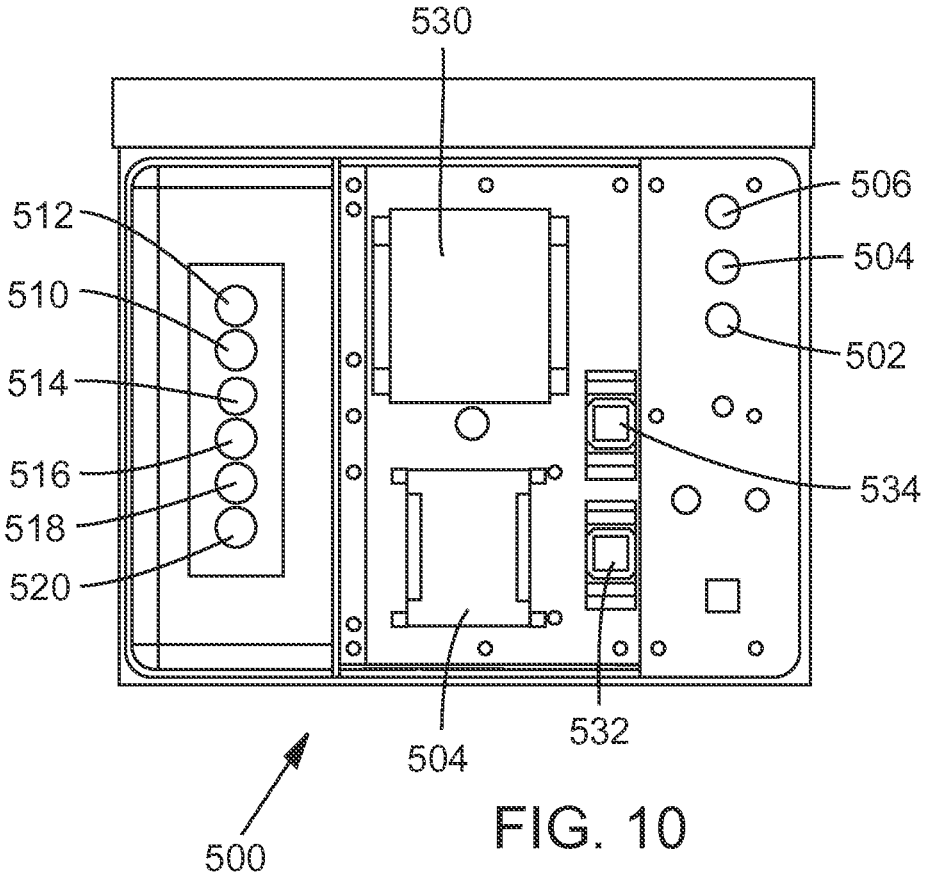
FIG. 10 is a plan view of an exemplary controller box used with the present invention.

The electronic control module 500 for apparatus 10 is shown in FIG. 10. Control module 500 is configured to control all operations of apparatus 10, including operation of the motor 114 and thus the drill bits 316. The vertical position of apparatus 10 in a pipe 402 may be separately controlled by a winch that pulls the suspension cable, or with a controller to control the winch. The controller 500 includes a programmable logic controller 504 and associated firmware and software to control apparatus 10. Among other control functions, control module 500 includes a main power switch 502, a step in button 504, step out button 506 and a set max button 508. A bit travel-in light 510 is illuminated when a bit 316 is being retracted and a bit travel-out light 512. Other controls include a peck cycle button 514 that causes the drill bits to drill out partially, drill out a little more, retract slightly, and so on until the drill reaches its full travel at which time it retracts fully; a half cycle button 516 that causes the drill bits to drill out and stop or retract and stop; and a full cycle button 518 that triggers each drill bit to drill fully out and then fully retract back into the drill cylinder (i.e., a full drill cycle). An emergency stop button 520 stops all operations when depressed.

The main panel of the electrical control module 500 has a standard 120 V 60 Hz AC outlet input, a 24 V 10 A DC output to the drill device (including power and data lines to the motor positioning encoder, also located in the drill device), and as noted a main power switch 502, and three that select the maximum distance the drill bits may travel outwards from the drill device, namely, a step in button 504 that steps the bits inwardly, the step out button 506 that steps the bits outwardly, and a set max button 508 that sets the maximum travel of the bits.

The 120 V AC power is converted to 24V DC via AC to DC converter 530. From the 24 V, programmed PLC 504 and relays 532 and 534 are powered.

As with the other components described herein, all materials within the electrical control module 500 are designed to withstand harsh environments. Specifically, the case in which control module 500 is housed is selected to be waterproof and not easily damaged. It will be appreciated that there are numerous styles of interfaces that may be used with control module 500 as the human-machine-interface ("HMI"), such as use of touch screen displays, etc.

In use, a well mount support 400 is connected to a pipe 402 as detailed above, with a winch mounted to winch attachment plate 414. An apparatus 10 with the desired number of drill assembly modules is assembled and the free end of a suspension cable 430 is attached to loop 110—the suspension cable is wound around the winch. The electrical power and control cable (not shown) at electrical connector fitting 108, utilizing a keeper 434 (FIG. 1), and the power and control cable is connect at its opposite end to the controller 500. After drill function has been verified, the motor casing is purged of oxygen and filled with inert gas.

The assembled and readied apparatus 10 is then inserted vertically into the pipe 402 and is dropped with the winch to the desired location in the pipe—the position of the apparatus 10 in pipe 10 is known by virtue of encoder 428, which is electronically interfaced with controller 500. The drill modules are then operated to perforate the walls of the pipe. The apparatus may be indexed upwardly and downwardly with the winch to drill perforations in the pipe at desired locations.

While the present invention has been described in terms of preferred and illustrated embodiments, it will be appreciated by those of ordinary skill that the spirit and scope of the invention is not limited to those embodiments, but extends to the various modifications and equivalents as defined in the appended claims.

We claim:

1. A well casing perforator, comprising:

a sealed motor housing adapted to preventing gas inflow to and outflow from the sealed motor housing, and having a diameter suitable for insertion of the sealed motor housing into a well casing, wherein said sealed motor housing includes an inlet port for purging said motor housing with inert gas and said well casing is a vertical landfill gas extraction well;

a motor in the sealed motor housing, said having an output shaft that rotates around a first axis;

at least one drill bit driven by said motor to rotate said drill bit around a second axis transverse to said first axis.

2. The well casing perforator according to claim 1 wherein rotation of said output shaft in a first rotational direction about the first axis causes said drill bit to extend from a first position in which the drill bit is within a drill housing in a first direction to an extended position in which the drill bit extends out of the drill housing.

3. The well casing perforator according to claim 2 wherein rotation of said output shaft in a second rotational direction causes said drill bit to retract from the extended position to the first position.

4. The well casing perforator apparatus according to claim 1 further comprising a second housing module attached to said first housing module and wherein said output shaft extends from the first housing module into said second housing module.

5. The well casing perforator apparatus according to claim 4 in which the output shaft drives first and second miter gears retained in the second housing module to convert rotation of the output shaft around the first axis to rotation of a first gear shaft in the second housing about an axis transverse to the first axis.

6. The well casing perforator apparatus according to claim 5 including at least one gear on a second gear shaft in the second housing module, and wherein the at least one gear on the second gear shaft in the second housing module interconnects with a gear on the first gear shaft in the second housing module to cause axial rotation of the second gear shaft in the second housing module.

7. The well casing perforator apparatus according to claim 6 wherein said housing further comprises a first drill bit housing module attached to said second housing module and wherein said at least one drill bit is in the first drill bit housing module.

8. The well casing perforator apparatus according to claim 7 further including plural additional drill bit housing modules, each of said plural additional drill bit housing modules attached to an adjacent drill bit housing module and each having a drill bit configured for movement between the first position to the extended position in a direction that is different from the drill bit in the adjacent drill bit housing module.

9. The well casing perforator apparatus according to claim 1 wherein the well casing has an axial center and the apparatus includes an adjustable centering apparatus for maintaining the position of the housing near the axial center of the well casing.

10. The well casing perforator apparatus according to claim 9 wherein the centering apparatus comprises plural adjustable centering skids located around an exterior of the housing at an upper end of the housing, and plural adjustable centering skids located around an exterior of the housing at a lower end of the housing.

11. The well casing perforator according to claim 10 including a winch having a cable attached to said housing for suspending said housing in said well casing and operable to shuttle said housing within said casing.

12. A well casing perforator apparatus, comprising:

a housing having a diameter suitable for insertion of the housing into a well casing, said housing defined by a motor module, a drive module and a drill module, each of the motor module, drive module and drill module defining separate modules that are interconnected about a common axis;

a motor in the motor module, said motor having an output shaft that rotates around a first axis;

gears in said drive module configured for translating rotation of the output shaft around the first axis to rotation of a gear shaft in said drive module around a second axis that is transverse to the first axis, said gear shaft having a drill drive gear thereon;

a drill bit and a thrust screw in the drill module, wherein the drill drive gear in the drive module meshes with a gear in the drill module to cause rotation of the drill bit and simultaneous movement of the drill bit from a home position in which the drill bit is retained in the housing and an extended position.

13. The well casing perforator apparatus according to claim 12 wherein the well casing has an axial center and including centering means for maintaining the housing near the axial center of a well casing into which the housing is inserted.

14. The well casing perforator apparatus according to claim 13 wherein the motor module is sealed and filled with an inert gas.

15. The well casing perforator apparatus according to claim 13 including plural drill modules, each drill bit module having a drill bit drive gear, a drill bit and a thrust screw, and rotation of the motor output shaft causes simultaneous movement of each drill bit from a home position in which the drill bit is retained in the housing and an extended position.

16. A method of perforating an existing in-ground well casing comprising the steps of:

a) providing a drill assembly having a motor contained in a sealed motor housing;

b) purging the sealed motor housing with an inert gas;

c) inserting into the casing a drill assembly having a motor and at least one drill bit;

d) adjusting the position of the drill assembly so that the at least one drill bit is positioned at a desired location;

e) operating the motor and thereby causing the at least one drill bit to perforate the well casing.

17. The method according to claim 16 wherein the step of purging the sealed motor housing with an inert gas eliminates oxygen from the drill assembly prior to insertion of the drill assembly into said casing.

* * * * *